US007823398B2

(12) United States Patent
Glen

(10) Patent No.: US 7,823,398 B2
(45) Date of Patent: Nov. 2, 2010

(54) COMPRESSOR/EXPANDER OF THE ROTATING VANE TYPE

(76) Inventor: John Stewart Glen, P.O. Box 1138, 250 Thomas St., Deep River, Ontario (CA) K0J1P0

( * ) Notice: Subject to any disclaimer, the term of this patent is extended or adjusted under 35 U.S.C. 154(b) by 753 days.

(21) Appl. No.: 11/382,048

(22) Filed: May 7, 2006

(65) Prior Publication Data

US 2007/0271951 A1 Nov. 29, 2007

(51) Int. Cl.
*F28B 9/00* (2006.01)

(52) U.S. Cl. ..... 62/172; 62/401

(58) Field of Classification Search ..... 62/172, 62/174, 86, 87, 176.3, 402, 401; 418/63, 418/64, 76, 77, 82, 83, 152; 417/372
See application file for complete search history.

(56) References Cited

U.S. PATENT DOCUMENTS 4,088,426 A * 5/1978 Edwards ..... 418/8
5,540,199 A * 7/1996 Penn ..... 123/243
5,681,153 A * 10/1997 Weatherston ..... 417/462
5,769,617 A * 6/1998 Glen ..... 418/13
5,819,554 A * 10/1998 Glen ..... 62/498
6,589,033 B1 * 7/2003 Johnson et al. ..... 418/13

* cited by examiner

*Primary Examiner*—Mohammad M Ali

(57) ABSTRACT

Improvements to a rotating-vane integral compressor/expander are outlined to significantly improve efficiency. A method to simply achieve variable-flow operation is also described.

5 Claims, 5 Drawing Sheets

SECTION XX COMPRESSOR

COMPRESSOR/EXPANDER OF THE ROTATING VANE TYPE

FIELD OF INVENTION

The invention is related to vane-type compressors, and in particular to the integral compressor/expander.

SUMMARY OF INVENTION

Minimizing energy consumption in all air-conditioning, refrigeration, and heat pump cycles is a most worthwhile objective. Two earlier patents (U.S. Pat. No. 5,769,617 and U.S. Pat. No. 5,819,554) describe how marrying a vane-type compressor with a vane-type expander in an integral unit, plus a control device upstream of the expander, can lead to optimal efficiency approaching the well known Carnot thermodynamic limit.

This patent outlines subtle improvements to the integral compressor/expander that are necessary to achieve minimal wasted internal energy losses, thereby achieving its full potential.

In this patent, the compressor rotor and expander rotor are fabricated as separate items, with a static casing component separating them and containing a proprietary seal rubbing or just clearing the shaft. This seal need not be a perfect seal, since the same refrigerant fluid exists on either side of the seal. This concept eliminates the much larger diameter seal of U.S. Pat. No. 5,769,617, with a smaller diameter lower friction seal.

However, an additional clearance between compressor-rotor and plate, and another at the expander-rotor are thereby introduced for a total of four clearances, and these clearances can result in excessive energy losses due to refrigerant leakage if not flooded with oil, or excessive friction if oil flooded. The objective is to eliminate leakage, yet minimize the friction of oil shear.

Any rubbing friction of the rotors against the static casing components should ideally be eliminated, and this can be done by judicious control of component dimensions. By use of shoulders on the shaft the separation distance between the two rotors can be limited to ensure no touching of the separating plate, while thrust bearing proudness limits the outermost flat rotor faces from rubbing on their adjacent casing components. In addition any necessary differential axial thermal expansion can be accommodated.

For example, if each rotor-flat-end clearance is 0.003 inch, and each thrust bearing 0.003 inch proud, then outer touching will not occur. The axial dimension between the shoulders of the shaft can ensure that the rotors do not touch the plate separating compressor and expander sections, yet can accommodate say up to 0.002 inch differential axial expansion. The rotors can be a sliding fit on the shaft with this arrangement, easing assembly/disassembly.

Now the oil is selected to have a sufficiently high viscosity to ensure the vanes have adequate lubrication, even allowing for refrigerant solubility significantly lowering oil viscosity. Normally a 0.003 inch clearance at rotor ends would be excessive in small machines, allowing oil flow (or refrigerant leakage) to be excessive. Excessive oil flow outgases and also heats up the compressor intake refrigerant, resulting in an additional energy loss. By using a positive displacement pump, conveniently located on the shaft, the oil flow can be constrained, corresponding to a small energy loss. While gear or Gerotor pumps are not new, their use to limit this energy loss on vane compressors is believed to be unique. Thus fabrication tolerances are eased by wider clearances, and energy losses due to oil shear and oil flow to intake, made minimal.

Two other areas may need oil flooding to inhibit excessive refrigerant leakage. One area is at the vane-flat-edges adjacent to the stationary casing flat faces. By recessing the vanes here, and allowing the recesses to fill with oil during part of the rotation, the refrigerant leakage is suppressed. This is a small loss region.

Another very significant leakage area is where the rotor is almost in touch with the casing (top-dead center on drawings). There may be sufficient oil pushed ahead by the vanes to flood this path, but if not then oil can be injected locally to this end.

In a similar manner extra oil can be injected into the rotor slots, if necessary, to ensure full lubrication of the vanes.

It is by judiciously minimizing all internal energy losses that the rotating vane machine can outperform its many competitors. Needle bearings on shaft and thrust units give low rolling friction, unnecessary rubbing is eliminated as above, small diameter proprietary seals running on the shaft mean low friction, hydrodynamic vane lubrication is employed, internal vapour leakage is largely eliminated via oil flooding, oil shear friction is made minimal, as are suction heating and outgassing, overcompression and by-pass energy losses.

Variable flow compressors have advantages in avoiding the inefficiencies of on/off clutch operation in automobiles. The compressor/expander system can also be made variable by regulating the expander inlet pressure, hence expander inlet fluid density.

DETAILED DESCRIPTION

Figure 1:
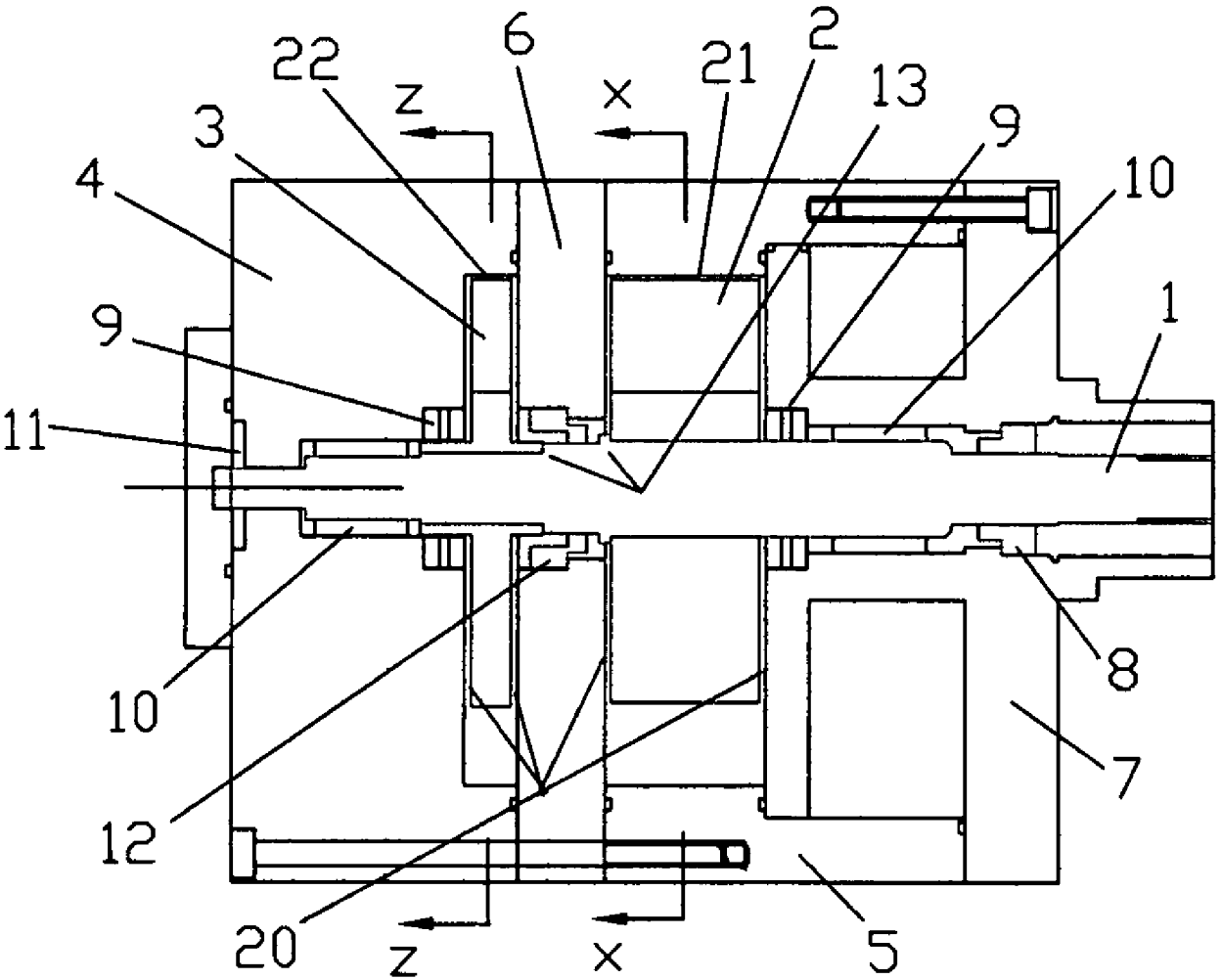
FIG. 1 shows a cross section through the compressor/expander assembly.
Figure 2:
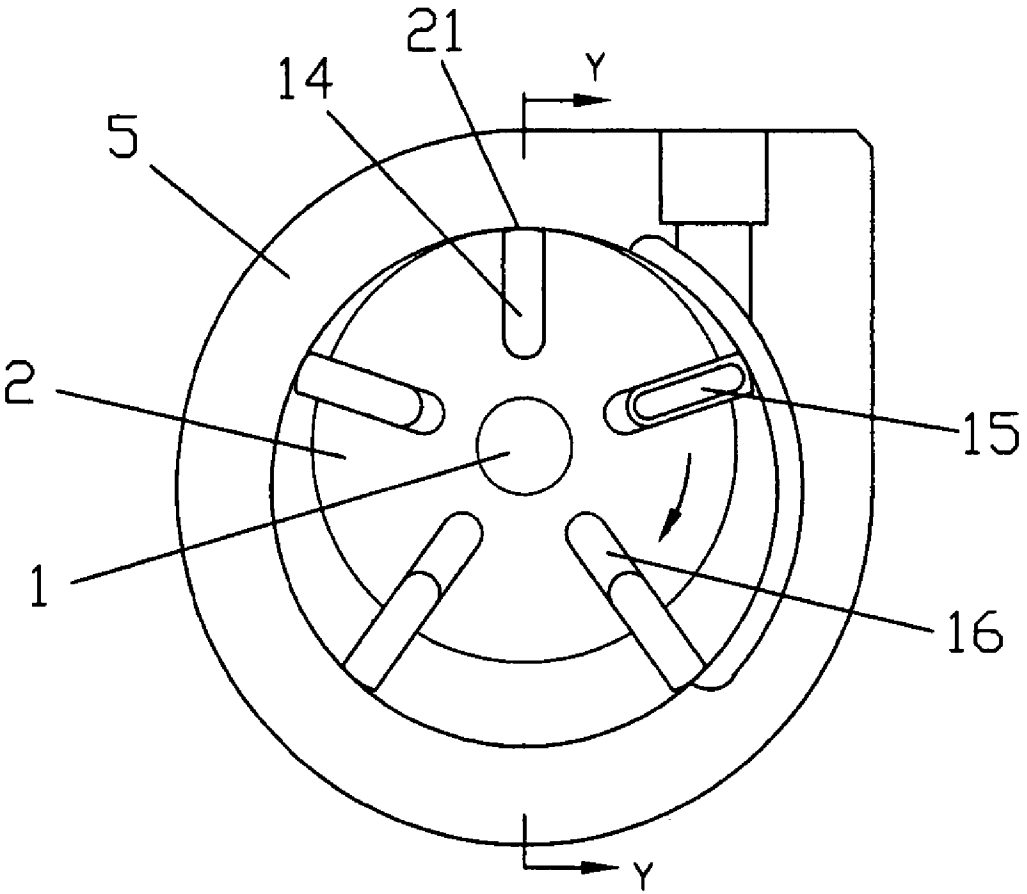
FIG. 2 shows a cross section through the compressor.
Figure 3:
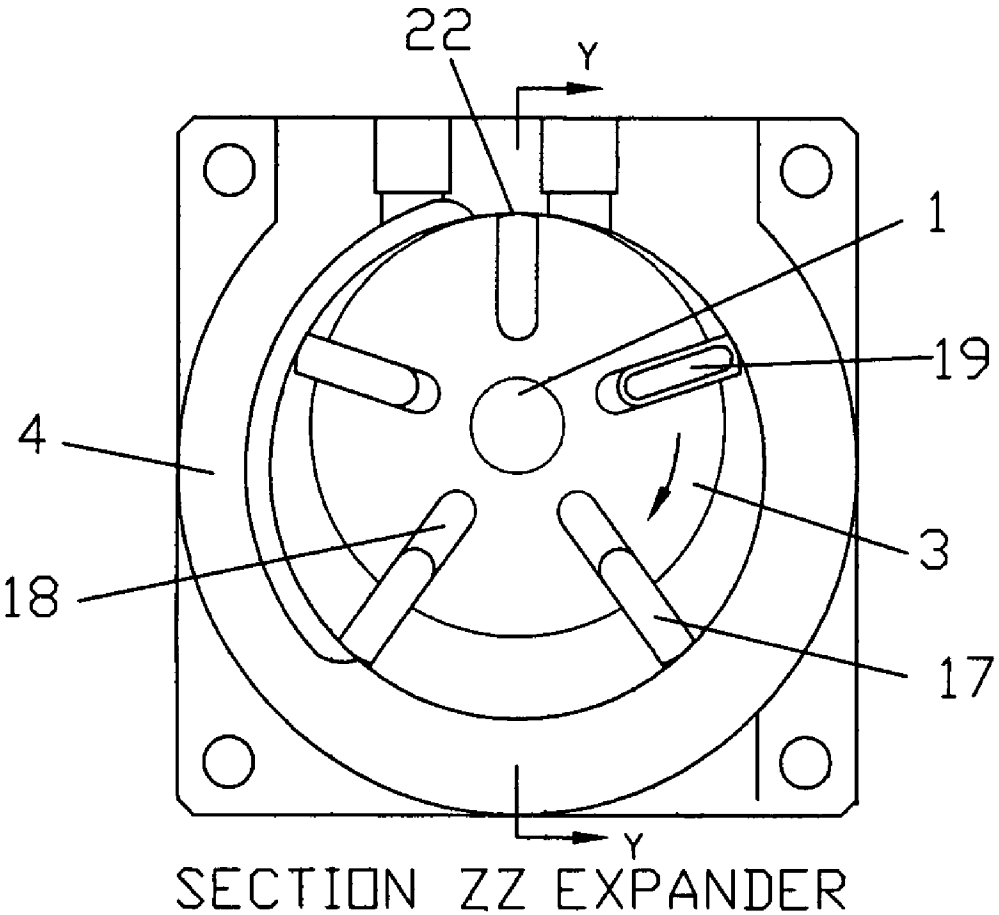
FIG. 3 shows a cross section through the expander.
Figure 5:
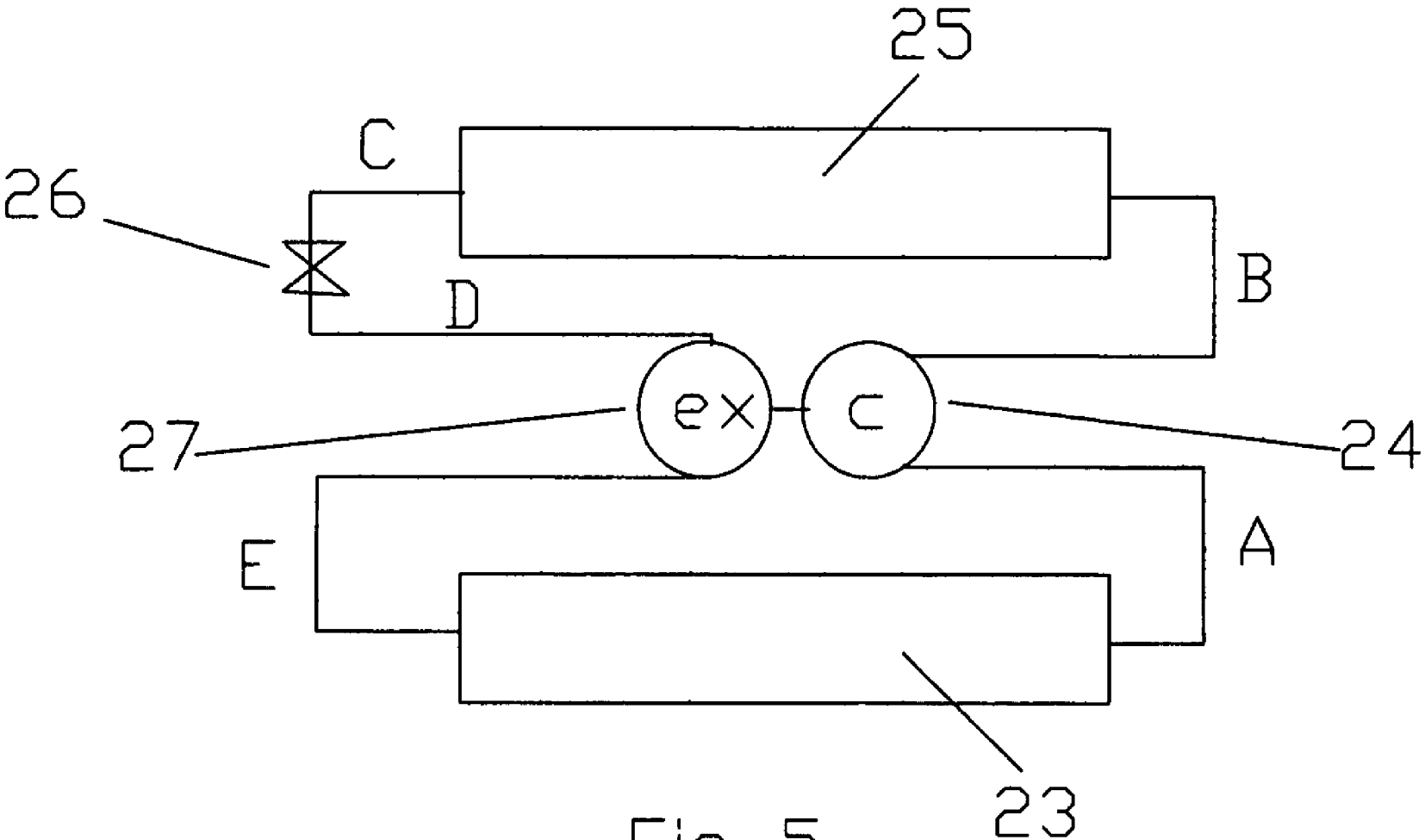
FIG. 5 shows an air-conditioning or refrigeration system containing a compressor, expander, and flow control device, corresponding to FIG. 4.

FIG. 1 shows an axial section through the vane-type compressor/expander, and should be read in conjunction with FIGS. 2, 3 and 5. A common shaft 1 turns a compressor rotor 2, and expander rotor 3. The compressor compresses refrigerant as in a conventional air-conditioning system, while a control device is followed by the expander to recover expansion energy, as explained in detail in U.S. Pat. No. 5,819,554, and shown in FIG. 5.

Additional features of FIG. 1 are an expander casing 4, compressor casing 5, and separating plate 6. Also shown are an oil/refrigerant separator chamber 7, a shaft seal 8, thrust bearing 9, shaft bearing 10, oil pump 11, a seal 12 riding on shaft 1 and separating compressor 2 and expander 3 rotors, and shaft shoulders 13 which keep the rotors 2 and 3 from rubbing the separating plate 6. Also shown are the fine clearances 20 between rotating components 2,3 and stationary components 4,6,7.

FIG. 2 is a radial section (xx of FIG. 1) through the compressor, showing shaft 1, compressor rotor 2, compressor casing 5, and compressor vanes 14, vane edge recesses 15, and rotor slots 16, and minimum clearance 21 between compressor rotor 2 and casing 5.

FIG. 3 is a radial section (zz of FIG. 1) through the expander, showing shaft 1, expander rotor 3, expander casing 4, and expander vanes 17, rotor slots 18, and vane edge recesses 19, and minimum clearance 22 between expander rotor 3 and casing 4.

Minimizing internal leakage losses is achieved by supplying oil to clearances 20, 21, 22 and 15,19

Figure 4:
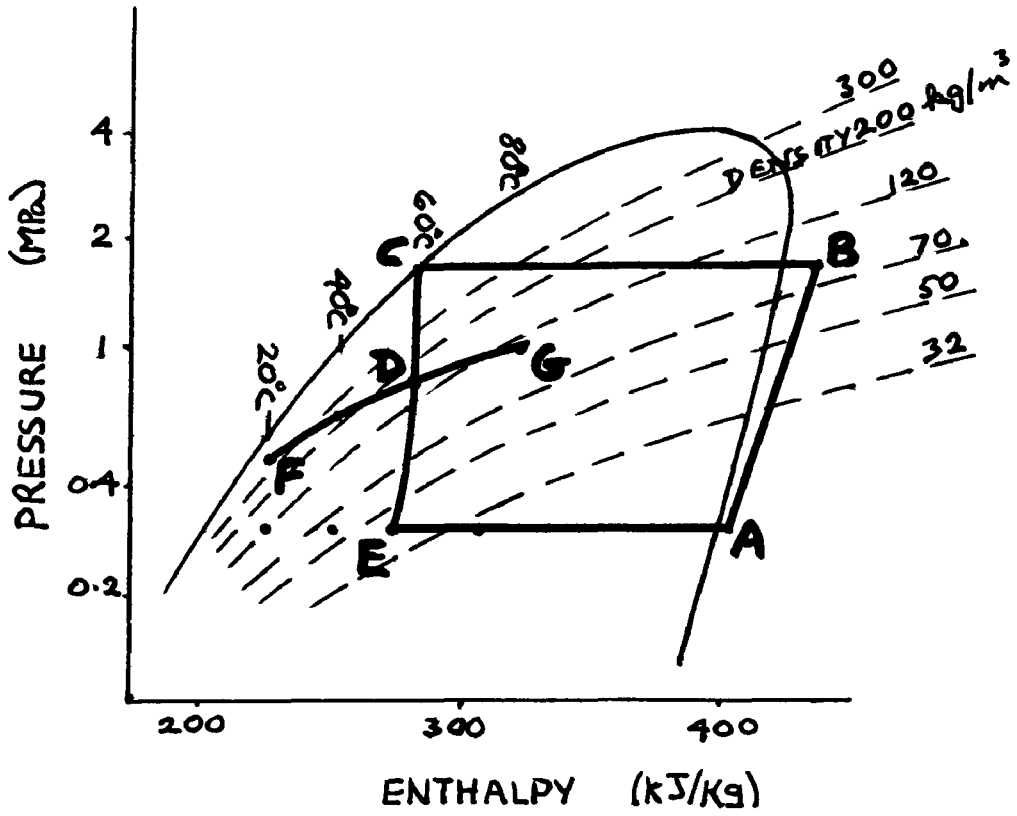
FIG. 4 shows a refrigerant pressure enthalpy graph, indicating how variable flow can readily be achieved for a compressor/expander system.

FIG. 5 shows a typical air-conditioning or refrigeration system with a compressor and expander section, that should be read with FIG. 4. An evaporator 23 supplies refrigerant to a compressor 24, followed by a condenser 25, a valve or control device 26, and expander 27. The compressor and expander are ideally on a common shaft as per FIG. 1, with a drive (not shown).

FIG. 4 shows a typical refrigerant pressure/enthalpy diagram, with the refrigerant cycle of a compressor/expander system superimposed. Compression AB is followed by condensation BC, then partial expansion CD typically in a valve or control device 26, then in the expander DE to recover energy, prior to evaporation EA.

FIG. 4 shows the refrigeration cycle ABCDE for condensing to a subcooled value of 60° C., while the device must also operate over a range from say 20° C. to 80° C., depending on ambient conditions. For an expander with a discharge/inlet volume ratio of say 4.0, it is necessary for the expander inlet pressure (hence two-phase fluid density) to be set above FDG so that adequate flow in the expander is achieved to match compressor flow requirements.

Now rather than use the on/off clutch typical of many automobile air-conditioning compressors, another more desirable type is the variable type, where refrigerant flow pumped by the compressor is mechanically varied over a wide range to eliminate on/off cycling. This can readily be accomplished in the compressor/expander system by regulating the position D in FIG. 4. As D approaches E, the expander intake density is reduced, resulting in a smaller refrigerant flow sent to the compressor and around the system for variable flow control. In the case where D is set in the region CD, the mass flow to the expander becomes greater than the compressor can pump, and so the compressor provides the common mass flow required for continuity.

I claim:

1. A rotating vane machine operating on a refrigeration, air-conditioning, or heat-pump cycle, wherein compression occurs within a compressor casing containing a cylindrical compressor rotor, and expansion occurs first in a valve or control device and thereafter within an expander casing containing a cylindrical expander rotor, said compressor and expander casings being located axially relative to each other, said rotors having flat end faces and being keyed to a common shaft, said compressor casing and expander casing being separated by a plate containing a seal riding on said shaft that inhibits leakage from said compressor casing to said expander casing and also in the reverse direction, the shaft being configured with a stepped up and stepped down portion between said compressor and said expander rotors, the seal is riding on the stepped down portion, the separating plate is configured in such a way that the plate is closely fitting on the seal and the stepped down portion of the shaft between the compressor and the expander rotors, said compressor rotor being driven by an external power source and said expander rotor returning expansion energy of the refrigerant to said shaft to reduce required input power, said shaft being supported in bearings, said rotors containing radial slots containing substantially rectangular vanes which have a close fitting arrangement with said casings and plate surfaces that abut said flat rotor faces, said rotors being eccentrically located within said casing components such that an exceedingly close but non-touching relationship exists between said rotors and casing components at their minimum clearance, said vanes having axial lengths and number of vanes to ensure the required volume ratios are achieved for said refrigeration, air-conditioning, or heat-pump cycle, said shaft containing two shoulders which together with two thrust bearings limit axial movement of said compressor and expander rotors to avoid rubbing friction against adjacent flat faces of said compressor and expander casings and separating flat plate, yet maintain fine clearances.

2. A rotating vane machine operating on a refrigeration, air-conditioning, or heat-pump cycle, wherein compression occurs within a compressor casing component containing a cylindrical compressor rotor, and expansion occurs first in a valve or control device and thereafter within an expander casing component containing a cylindrical expander rotor, said compressor and expander casing components being located axially relative to each other, said rotors being either joined or separated, where separated the shaft being configured with a stepped up and stepped down portion between said compressor and said expander rotors, the seal is riding on the stepped down portion, the separating plate is configured so that the plate is closely fitting on the seal and the stepped down portion of the shaft and between the compressor and the expander rotors, said rotors having flat end faces and being keyed to a common shaft, said compressor rotor being driven by an external power source and said expander rotor returning expansion energy of the refrigerant to said shaft to reduce required input power, said shaft being supported in bearings, said rotors containing radial slots containing substantially rectangular vanes which have a close fitting arrangement with said casings and plate surfaces that abut said flat rotor faces, said rotors being eccentrically located within said casing components such that an exceedingly close but non-touching relationship exists between said rotors and casing components at their minimum clearance, said vanes having axial lengths and number of vanes to ensure the required volume ratios are achieved for said refrigeration, air-conditioning, or heat-pump cycle, said shaft driving an oil pump that supplies oil into the fine clearances at the minimum clearances and fine clearances between rotating and stationary components to suppress internal leakage of refrigerant vapor, said oil being supplied at a pressure higher than opposing refrigerant pressure to ensure oil flooding of said clearances.

3. The vane-type compressor/expander of claim 2, where the vane lateral edges are recessed and allowed to fill with oil during part of rotation to suppress refrigerant leakage, and to rotor slots to ensure vane lubrication.

4. The vane-type compressor/expander of claim 2 with a valve or control device upstream of the expander, said control device being constrained to operate within a higher range of output pressures corresponding to a high range of refrigerant densities supplied to said expander, thus the refrigerant flow becomes the compressor output and variable cooling is obtained by on/off control.

5. The vane-type compressor/expander of claim 2 with a control device or valve upstream of the expander, where variable volume control is achieved by adjusting the control device outlet pressure and hence expander inlet pressure and thus two-phase fluid density in a lower range thereby variably controlling the refrigerant flow through the compressor/expander, thereby allowing continuous operation at the reduced load rather than by on/off control.

* * * * *